US006276815B1

(12) United States Patent
Wu

(10) Patent No.: US 6,276,815 B1
(45) Date of Patent: Aug. 21, 2001

(54) INFLATABLE ILLUMINATING DEVICE

(76) Inventor: Jeng-shyong Wu, No. 14, Alley 1, Lane 326, Shih-Pin Rd., Hsinchu (TW)

( * ) Notice: Subject to any disclaimer, the term of this patent is extended or adjusted under 35 U.S.C. 154(b) by 0 days.

(21) Appl. No.: 09/407,080

(22) Filed: Sep. 28, 1999

(51) Int. Cl.[7] ..... F21W 19/00; F21W 121/00

(52) U.S. Cl. ..... 362/234; 362/249; 362/253; 362/806; 446/220

(58) Field of Search ..... 362/227, 234–237, 362/249, 252, 253, 806; 446/219, 220, 223, 485

(56) References Cited

U.S. PATENT DOCUMENTS 3,745,677 * 7/1973 Moran ..... 362/320
3,829,678 * 8/1974 Holcombe ..... 362/34
4,015,111 * 3/1977 Spector ..... 362/34
5,117,344 * 5/1992 Perez ..... 362/253
5,228,686 * 7/1993 Maleyko ..... 362/190
5,639,076 * 6/1997 Cmiel et al. ..... 473/570
5,947,581 * 9/1999 Schrimmer et al. ..... 362/96

* cited by examiner

*Primary Examiner*—Alan Cariaso
(74) *Attorney, Agent, or Firm*—Dougherty & Troxell

(57) ABSTRACT

An inflatable illuminating device comprising an inflatable body and illuminating devices. The inflatable body has a fixed shape made of transparent, semi-transparent, or colored soft plastic piece and is sealed as a hollow body, the inflatable body has an inflatable opening and open bags at its outer surface. The illuminating device is formed by an illuminating body, a protecting case and a fixing seat. The protecting case and the illuminating body are installed within a container at the outer surface of the body for being fixed. As the light from the illuminating devices pass through, reflected from or refracted through the inflatable body, the illuminating device will present the variation of illumination. As the inflatable opening is opened, and gas is released, the volume will be reduced.

8 Claims, 6 Drawing Sheets

INFLATABLE ILLUMINATING DEVICE

FIELD OF THE INVENTION

The present invention relates to an inflatable illuminating device, and especially to an inflatable body with illuminating devices which may present various variations by the illuminating devices.

BACKGROUND OF THE INVENTION

The present invention relates to an inflatable illuminating device, in which an inflatable body with illuminating devices which may present various variations by the illuminating devices. Although, in the market, various inflatable bodies are commercially sold, no inflatable body may emit light. Therefore, such an inflatable body is only used in a light environment. Moreover, one inflatable body presents no variations.

SUMMARY OF THE INVENTION

Accordingly, the primary object of the present invention is to provide an inflatable illuminating device comprising an inflatable body and illuminating devices. The inflatable body has a fixed shape made of transparent, semi-transparent, or colored soft plastic material and is sealed as a hollow body. By this structure, the inflatable body has various variations.

In the present invention, the inflatable body has an inflatable opening and open bags at its outer surface. The illuminating device is formed by an illuminating body, a protecting case and a fixing seat.

Moreover, the protecting case and the illuminating body are installed within a container at the outer surface of the body for being fixed. As the light from the illuminating devices passes through, reflected from or refracted through the inflatable body, the illuminating device will present variations of illumination. As the inflatable opening is opened, and gas is released, the volume will be reduced.

The various objects and advantages of the present invention will be more readily understood from the following detailed description when read in conjunction with the appended drawing.

DETAILED DESCRIPTION OF THE PREFERRED EMBODIMENTS

Figure 1A:
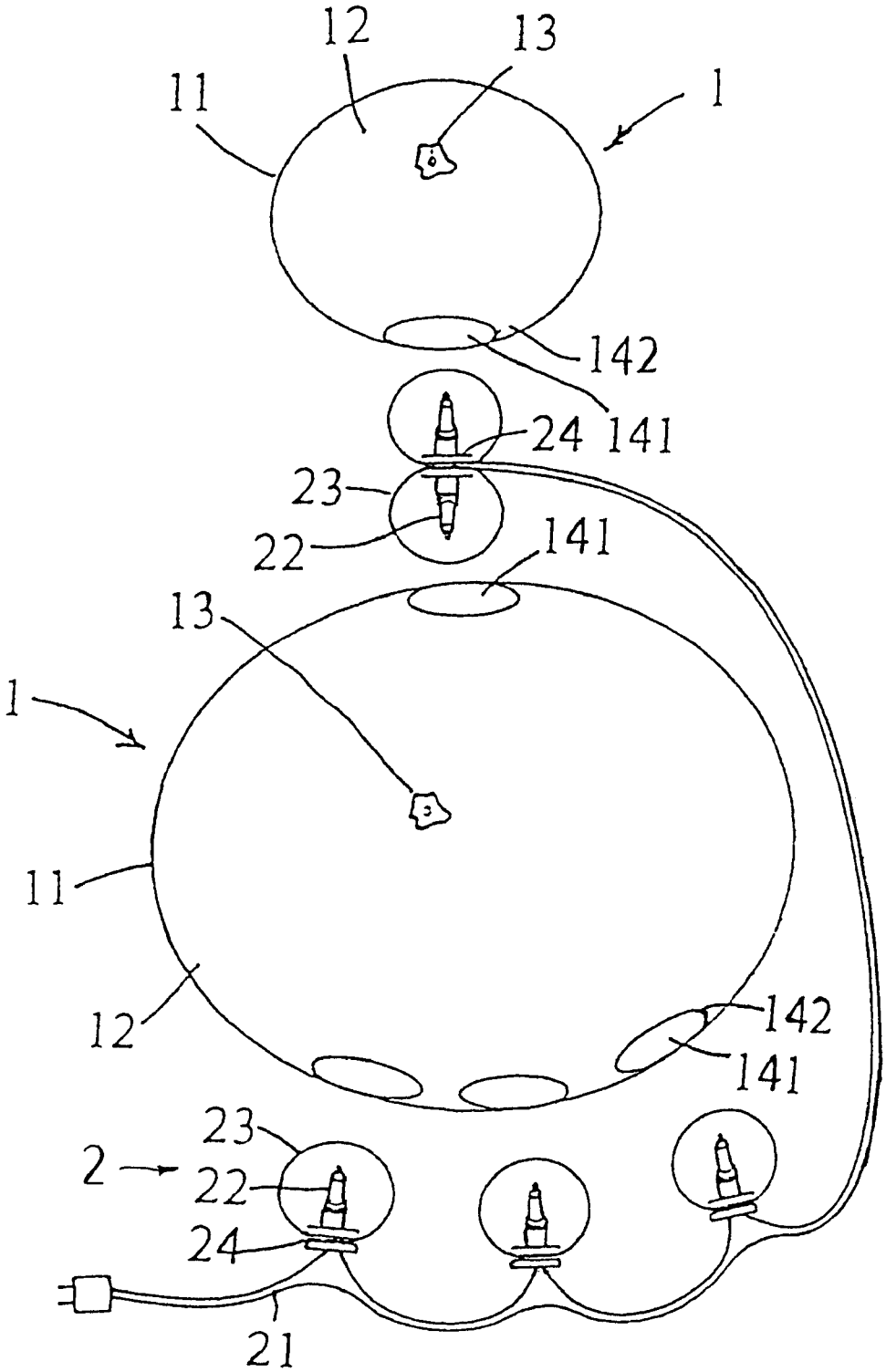
FIG. 1A is a schematic exploded view showing the inflatable illuminating device in one embodiment of the present invention.
Figure 1B:
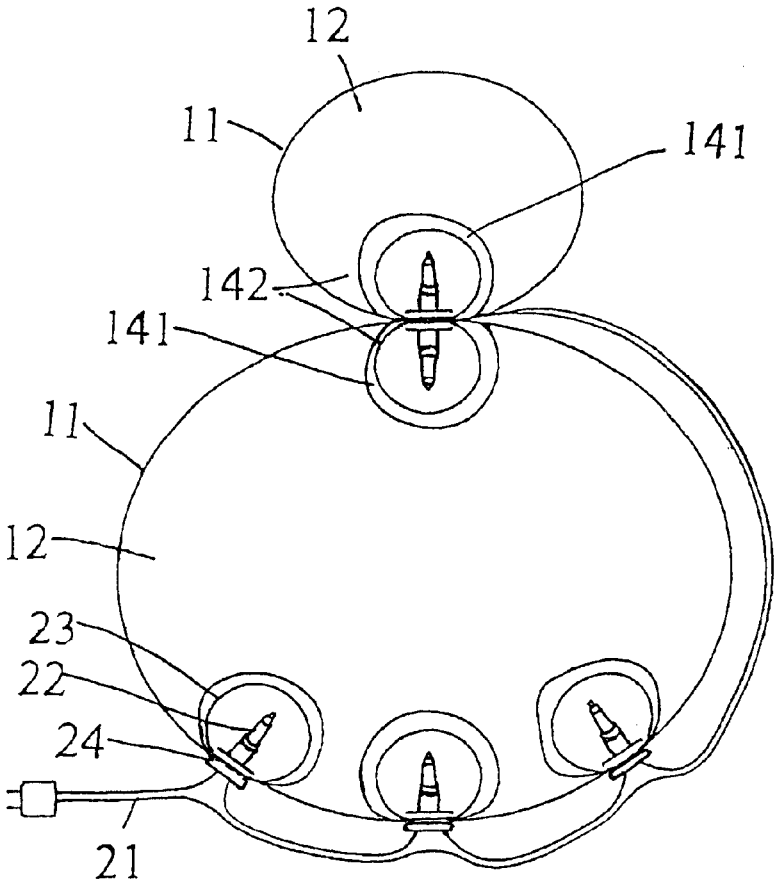
FIG. 1B is a cross-sectional view showing the whole structure of the inflatable illuminating device in FIG. 1A.

FIG. 1 shows an embodiment of the present invention. An inflatable body 1 has a fixed shape made of transparent, semi-transparent, or colored soft plastic material 11. An inflation opening 13 is formed thereon and serves to inflate gas into a hollow portion 12 which may be formed with various shapes. The outer edge, lateral side, upper side and lower side of the inflatable body have one or more concave holes 141 for fixing illuminating devices. The illuminating device 2 is formed by a plurality of bulbs 22 which are connected in series and are connected to a power source in series. In use, these devices are arranged in the holes to be fixed. Protecting cases 23 serve to protect the bulbs 22 and are fixed by the fixing seat 24. FIG. 1B shows the present invention with illuminating devices. Each illuminating device 2 is installed within a respective hole 141 to be fixed therein. The protecting case 23 is now assembled to inflatable body 1. The fixing seats 24 are fixed to the outer edges 142 of the openings of the holes 141 for fixing the illuminating devices.

Figure 2A:
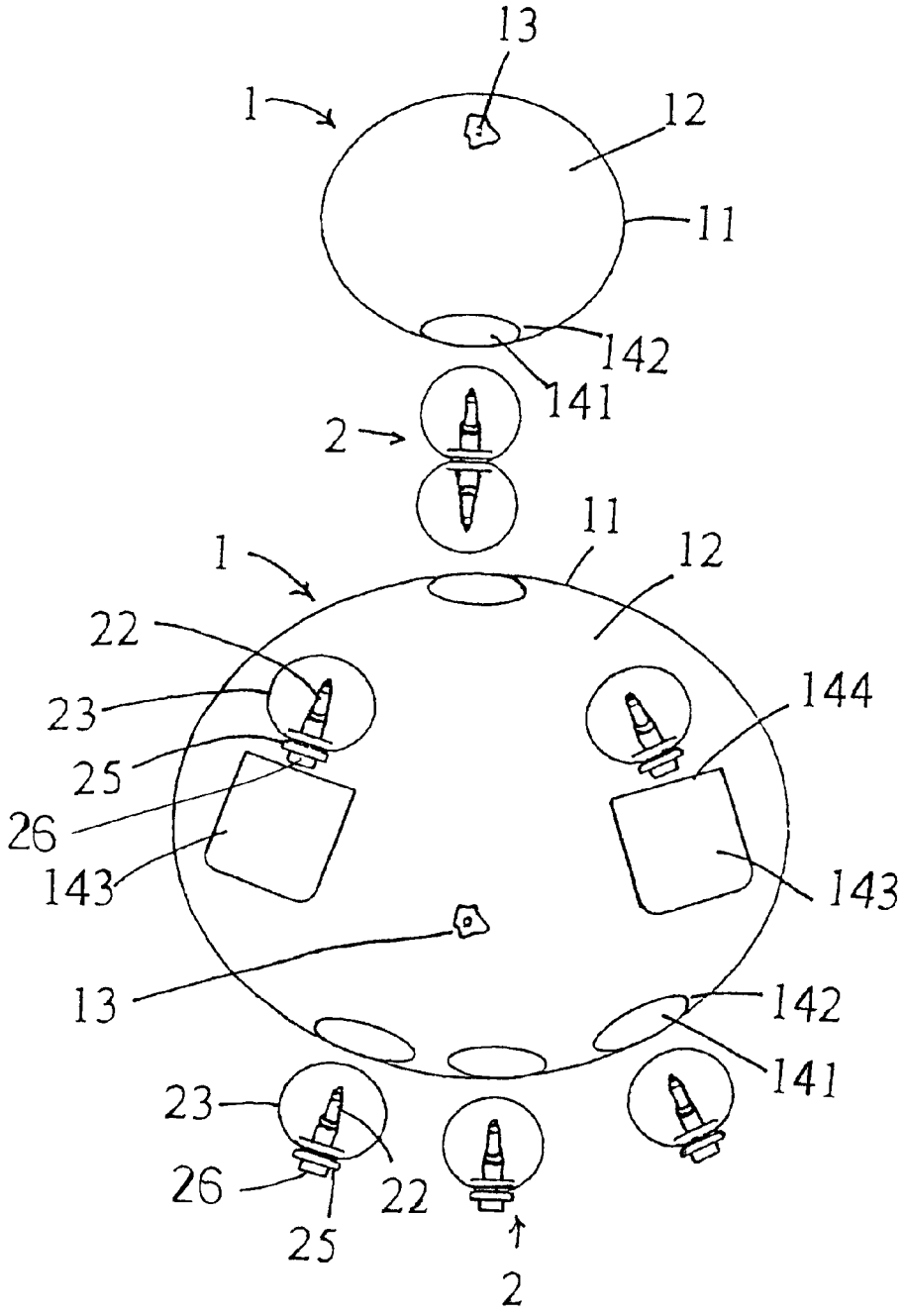
FIG. 2A is a schematic exploded view showing the inflatable illuminating device in another embodiment of the present invention.
Figure 2B:
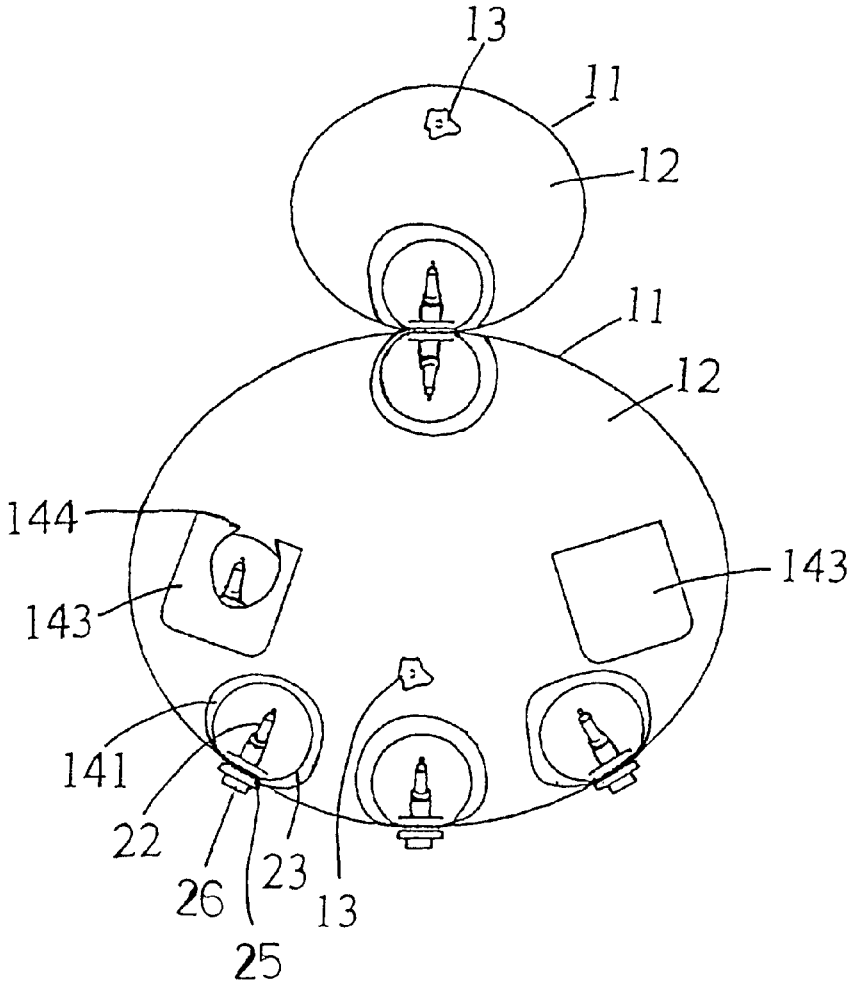
FIG. 2B is a cross-sectional view showing the whole structure of the inflatable illuminating device in FIG. 2A.

FIG. 2A shows another embodiment of the present invention. The inflatable body 1 has bags 143 with an opening 144 for receiving the illuminating device 2. In this embodiment of the present invention, an alternative current power is replaced by a battery 26 which is fixed in a battery seat 25. FIG. 2B shows the open bags 143 and holes 141 being installed with a plurality of illuminating devices. Since the inner and outer sides of the inflatable body are installed with illuminating devices, the illumination may be varied.

Figure 3A:
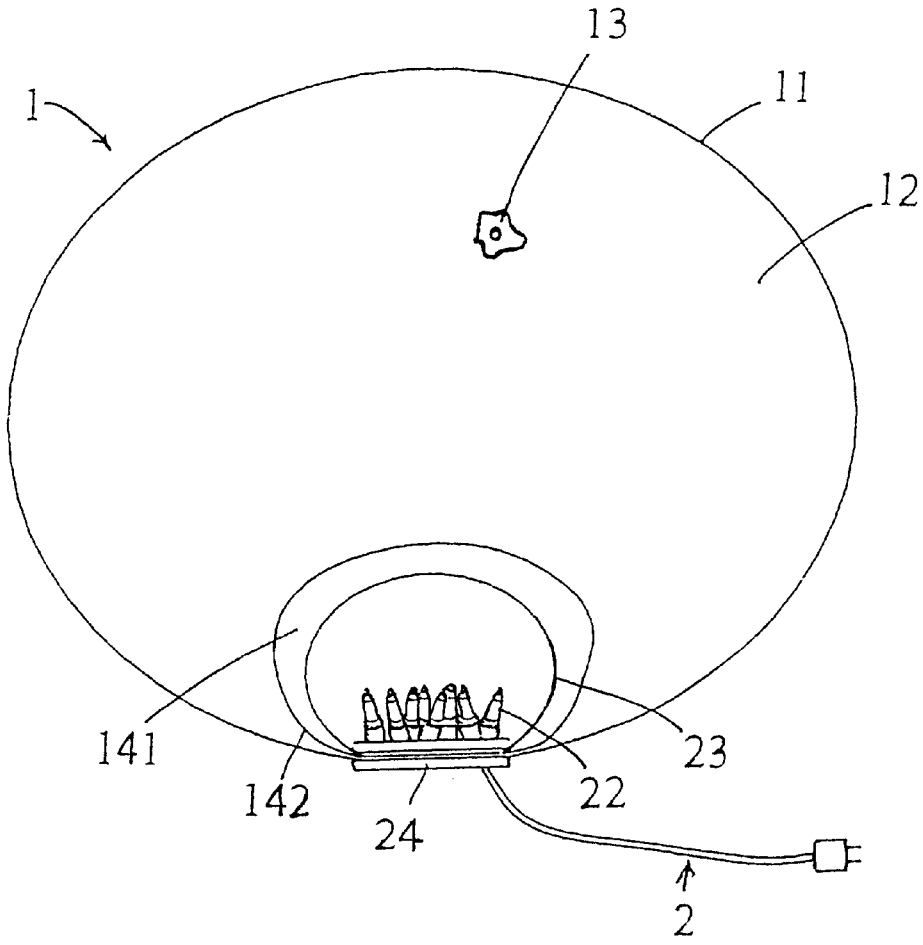
FIG. 3A is a cross-sectional view showing the inflatable illuminating device in a further embodiment of the present invention.
Figure 3B:
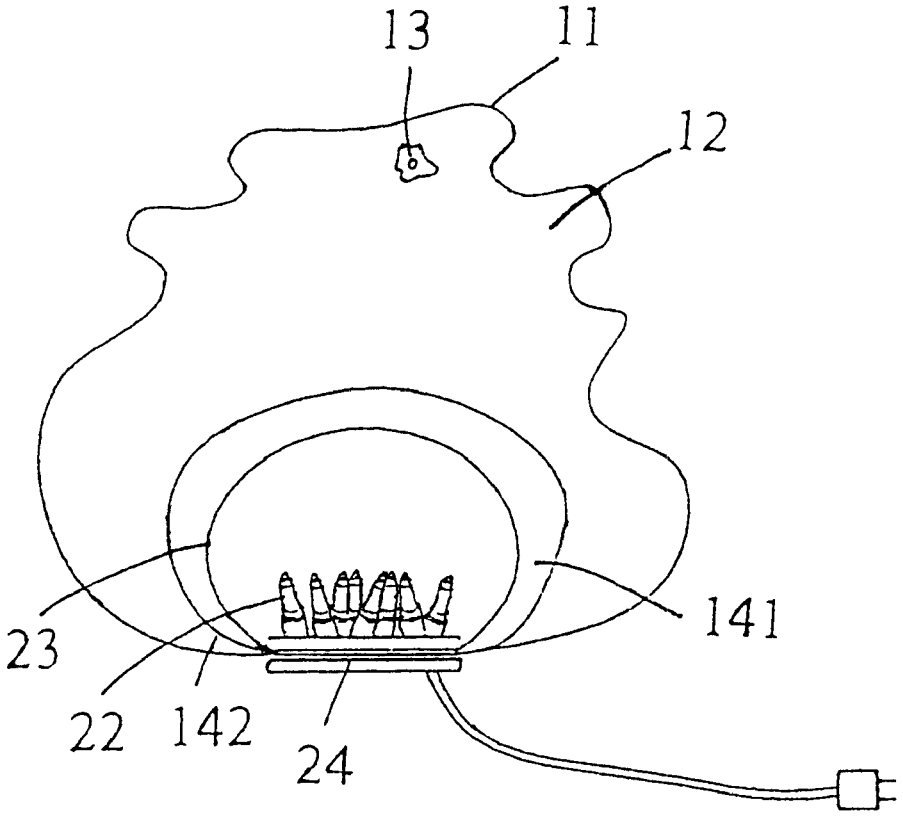
FIG. 3B is a cross-sectional view showing the whole structure of FIG. 3A with a deflated volume.

FIG. 3A shows an embodiment with a plurality of illuminating devices installed on the inflatable body, and the illuminating bodies are connected with each other. In this embodiment, a plurality of bulbs 22 are installed in a fixing seat 24 which is fixed at the outer edge 142 of the hole of the inflatable body 1. In this embodiment, the light is concentrated, thus, it can be designed for enhancing the illumination of some part. The power can be alternative current. FIG. 3B shows an inflatable body with reduced air, wherein the inflation opening 13 is opened for releasing air.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An inflatable illuminating device comprising:

a) an inflatable body having an inflation opening for inflating and deflating the inflatable body, the inflatable body having an outer surface and at least one concave hole extending into an interior of the inflatable body through the outer surface thereof when the inflatable body is inflated, each concave hole having an outer edge bounding a single opening through the outer surface of the inflatable body;

b) an illuminating device having: a fixing seat; at least one electrical bulb mounted in the fixing seat; and a protecting case mounted on the fixing seat and enclosing the at least one bulb, whereby the fixing seat is fixed to the outer edge of the at least one concave hole such that the at least one bulb and the protecting case are located within the at least one concave hole; and, c) electrical power connection on the fixing seat.

2. The inflatable illuminating device of claim 1 wherein the electrical power connection includes an electrical power cord connected to each fixing seat.

3. The inflatable illuminating device of claim 1 wherein the electrical power connection includes a battery mounted on each fixing seat.

4. The inflatable illuminating device of claim 1 further comprising a plurality of electrical bulbs mounted on the fixing seat.

5. The inflatable illuminating device of claim 1 further comprising at least one bag on the outer surface of the inflatable body and an illuminating device located within the at least one bag.

6. The inflatable illuminating device of claim 5 further comprising a plurality of bags each with an illuminating device therein.

7. The inflatable illuminating device of claim 6 further comprising a plurality of concave holes, each having an illuminating device.

8. The inflatable illuminating device of claim 1 further comprising a plurality of concave holes, each having an illuminating device.

* * * * *